US007115881B2

(12) United States Patent
Rabinowitz et al.

(10) Patent No.: US 7,115,881 B2
(45) Date of Patent: Oct. 3, 2006

(54) POSITIONING AND MOTION CONTROL BY ELECTRONS, IONS, AND NEUTRALS IN ELECTRIC FIELDS

(76) Inventors: Mario Rabinowitz, 715 LaKemead Way, Redwood City, CA (US) 94062-3922; Mark Davidson, 807 Rorke Way, Palo Alto, CA (US) 94303

( * ) Notice: Subject to any disclaimer, the term of this patent is extended or adjusted under 35 U.S.C. 154(b) by 900 days.

(21) Appl. No.: 10/162,499

(22) Filed: Jun. 4, 2002

(65) Prior Publication Data

US 2004/0161332 A1 Aug. 19, 2004

(51) Int. Cl.
*F03H 3/00* (2006.01)
*H05H 1/00* (2006.01)

(52) U.S. Cl. ..... 250/423; 60/202

(58) Field of Classification Search ..... 250/423, 250/251; 60/202

See application file for complete search history.

(56) References Cited

U.S. PATENT DOCUMENTS 4,210,847 A 7/1980 Shannon et al. ..... 315/111.91
4,574,092 A 3/1986 Gourdine ..... 427/479
5,181,016 A 1/1993 Lee ..... 345/84
5,294,079 A * 3/1994 Draznin et al. ..... 244/169
5,369,953 A * 12/1994 Brophy ..... 60/202
5,705,969 A 1/1998 Edamura et al. ..... 335/228
5,855,801 A 1/1999 Lin et al. ..... 216/2
5,924,277 A * 7/1999 Beattie et al. ..... 60/202
5,980,719 A 11/1999 Cherukuri et al. ..... 204/600
6,145,298 A 11/2000 Burton ..... 60/202
6,640,535 B1 * 11/2003 Gallimore et al. ..... 60/202
6,834,492 B1 * 12/2004 Hruby et al. ..... 60/202

* cited by examiner

*Primary Examiner*—David A. Vanore

(57) ABSTRACT

This invention deals with novel method and apparatus for positioning and motion control by rapid-response motorless linear motion, angular deflection, and continuous rotational motion utilizing the force due to electrons, ions, and/or neutrals. Thus forces and torques are produced without the use of internal moving parts. Control is achieved without recourse to magnetic fields, by means of high electric fields which may be attained at relatively low voltages. At low voltages, the instant invention exceeds the capability of conventional systems. It can perform dynamic motion control over a wide range of dimensions and signal bandwidth with independent amplitude and frequency modulation. Since there are no internal moving parts, the instant invention is the most adapted for fabrication at the micro and nanotechnology realms. Furthermore it provides less costly and greater ease of manufacture from the nano-to the macro-realm.

50 Claims, 7 Drawing Sheets

POSITIONING AND MOTION CONTROL BY ELECTRONS, IONS, AND NEUTRALS IN ELECTRIC FIELDS

BACKGROUND OF THE INVENTION

1. Field of the Invention

This invention relates generally to method and apparatus for positioning and motion control by the force due to electrons, ions, and/or neutrals. The instant invention can perform dynamic motion control over a wide range of dimensions and signal bandwidth. Motorless linear motion, angular deflection, and continuous rotation are achieved without recourse to magnetic fields. Preferably this invention lends itself readily to the field of nanotechnology, although it is also applicable to the macro-realm.

2. Description of the Prior Art

No prior art was found by us related to positioning and motion control by electrons, ions and neutrals in electric fields. The prior art has investigated various forms of rocket propulsion systems and ion engines for high altitude and space applications. The rocket and ion engines of the prior art are for a different purpose and use principles in a different way than the present invention. Such prior art engines generally operate at high temperatures and attempt to either burn or ionize the highest possible percentage of the propellant since the propellant fuel must be carried with the airborne or space borne vehicle and cannot be wasted. They operate at very high levels of power consumption, and utilize such exotic types of propellants, producing large amounts of pollution by-products, since they require much higher levels of forces than needed to practice our invention. Except for applications in outer space such devices are for the most part not practical due to their size, weight and power requirements. We found no prior art that utilized field emission for force production. Furthermore, our instant invention is preferably not operated at high temperatures or high degrees of ionization.

Lindenblad's U.S. Pat. No. 2,765,975 discloses an ionic wind generating duct to provide space propulsion by employing a series of ion producing ion brooms connected to a high voltage source of either polarity. The ion brooms are disposed in a pipe or duct with alternating conductive and insulating sleeves which terminate in positive and negative voltage sources. His invention differs from the instant invention in application, in design, in construction, in apparatus, in method, and in required power level.

Coleman, et al. U.S. Pat. No. 3,071,705 creates propulsion by an "electric wind" resulting from the application of a high voltage positive charge to an anode having a torpid connected to an ionization head. The torpid ionization head anode is placed in axial alignment with a cathode target having a metal ring connected to a target with the flow of air and corona discharge moving from the anode to the cathode. Their invention differs from the instant invention in application, in design, in construction, in apparatus, in method, and in required power level.

Burton's U.S. Pat. No. 6,145,298 ion engine creates a negative ionic plasma between a cathode ion thruster and a ring-shaped anode in a housing composed of an electrical insulative material in which the cathode ion thruster is charged to −18 to −110 kilovolts (kv) to utilize ambient atmospheric gas as the propellant. This engine produces ozone, which although it is compatible with and even needed in outer space, is toxic in the environment of the earth's surface. His invention differs from the instant invention in application, in design, in construction, in apparatus, in method, and in required power level.

In our prior art search, we found one book that is an excellent source of information. It is "Microactuators: Electrical, Magnetic, Thermal, Optical, Mechanical, Chemical, and Smart Structures," by Massood Tabib-Azar (copyright 1998). This comprehensive book is a compendium of work in the field with hundreds of references, and covering a multitude of mechanisms and devices. The impressive collection of material in this book does not anticipate the teaching of our invention.

In general, the processes as taught in our invention are uniquely distinct and different from the prior art found by us. Unlike the prior art, the instant invention relates to positioning and motion control ideally suited for nanotechnogy by electron, ion, and/or neutral momentum transfer. A large representative sample of 35 prior art U.S. patents with No. and Title will next be presented. This together with the references contained therein constitutes a comprehensive compendium showing that our invention operates in ways not foreseen by the prior art.

1. U.S. Pat. No. 6,379,895 Photolithographic and Other Means for Manufacturing Arrays
2. U.S. Pat. No. 6,375,089 Multiple Sprayer Assembly and Method for Use
3. U.S. Pat. No. 6,374,909 Electrode Arrangement for Electrohydrodynamic Enhancement of Heat and Mass Transfer
4. U.S. Pat. No. 6,364,460 Liquid Delivery System
5. U.S. Pat. No. 6,349,740 Monolithic High Performance Miniature Flow Control Unit
6. U.S. Pat. No. 6,331,439 Device for Selective Distribution of Liquids
7. U.S. Pat. No. 6,326,211 Method of Manipulating a Gas Bubble in a Microfluidic Device
8. U.S. Pat. No. 6,318,640 Dispensing Device
9. U.S. Pat. No. 6,312,110 Methods and Apparatus for Electrohydrodynamic Ejection
10. U.S. Pat. No. 6,302,331 Directionally Controlled EHD Aerosol Sprayer
11. U.S. Pat. No. 6,284,113 Apparatus and Method for Transferring Liquids
12. U.S. Pat. No. 6,278,111 Electrospray for Chemical Analysis
13. U.S. Pat. No. 6,260,579 Micropump and Method of Using a Micropump for Moving an Electrosensitive Fluid
14. U.S. Pat. No. 6,252,129 Dispensing Device and Method for Forming Material
15. U.S. Pat. No. 6,234,402 Stabilized Capillary Microjet and Devices and Methods for Producing Same
16. U.S. Pat. No. 6,203,683 Electrodynamically Focussed Thermal Cycling Device
17. U.S. Pat. No. 6,200,539 Paraelectric Gas Flow Accelerator
18. U.S. Pat. No. 5,980,719 Electrohydrodynamic Receptor
19. U.S. Pat. No. 5,909,813 Force Field Separator
20. U.S. Pat. No. 5,855,801 IC-Processed Microneedles
21. U.S. Pat. No. 5,705,969 Actuator
22. U.S. Pat. No. 5,181,016 Micro-Valve Pump Valve Display
23. U.S. Pat. No. 4,953,407 Ion-Drag Flowmeter
24. U.S. Pat. No. 4,720,640 Fluid Powered Electrical Generator
25. U.S. Pat. No. 4,574,092 Electrogasdynamic Coating System
26. U.S. Pat. No. 4,555,909 Method and Apparatus for Improved Cooling of Hot Materials 27. U.S. Pat. No. 4,339,678 Multistaged electrohydrodynamic (EHD) Generator with Parallel Outputs
28. U.S. Pat. No. 4,380,720 Apparatus for Producing a Directed flow of a Gaseous Medium Utilizing the Electric Wind Principle
29. U.S. Pat. No. 4,259,409 Electrogasdynamic Coating Apparatus
30. U.S. Pat. No. 4,210,847 Electric Wind Generator
31. U.S. Pat. No. 4,206,396 Charged Aerossol Generator with Uni-Electrode Source
32. U.S. Pat. No. 4,197,289 Novel Dosage Forms
33. U.S. Pat. No. 4,109,027 Electrostatic Coating Apparatus and Method
34. U.S. Pat. No. 4,072,477 Electrostatic Precipitation Process
35. U.S. Pat. No. 4,020,393 Electrogasdynamic Coating Device Having Composite Non-Conductive Flow Channel, and Hollow Ionization Electrode for an Air Jet.

DEFINITIONS

"Elastomer" is a material such as synthetic rubber or plastic, which at ordinary temperatures can be stretched substantially under low stress, and upon immediate release of the stress, will return with force to approximately its original length.

"Electric field" or "electric stress" refers to a voltage gradient. An electric field can produce a force on charged objects, as well as neutral objects. The force on neutral objects results from an interaction of the electric field on intrinisic or induced electric polar moments in the object.

"Electrical breakdown" occurs when a high enough voltage or electric field is applied to a dielectric (vacuum, gas, liquid, or solid) at which substantial electric charge is caused to move through the dielectric.

"Enhanced or macroscopic electric field" is the electric field enhanced by whiskers very near the electrodes based upon the local (microscopic) geometry on the surface of the electrodes.

"Enhancement factor" is the ratio of the microscopic to the macroscopic electric field, and denoted herein by the symbol $\beta$.

"Ferrofluid" is a fluid colloidal suspension of ferromagnetic particles in a liquid. The ferrofluid can be made rigid by application of a magnetic field.

"Field emission or cold emission" is the release of electrons from the surface of a cathode (usually into vacuum) under the action of a high electrostatic field $\sim 10^7$ V/cm and higher. The high electric field sufficiently thins the potential energy barrier so that electrons can quantum mechanically tunnel through the barrier even though they do not have enough energy to go over the barrier. This is why it is also known as "cold emission" as the temperature of the emitter is not elevated.

"Macroscopic electric field" is the applied electric field on the basis of the imposed voltage and the gross (macroscopic) geometry of the electrodes, and which is relevant as long as one is not too near the electrodes.

"Mean free path" of a particle is the average distance the particle travels between collisions in a medium. It is equal to [number density of the medium x collision cross-section]$^{-1}$.

"Negative ion" is a neutral atom or molecule which has captured one or more electrons.

"Negative ion emission" as used herein is the induced emission of negative ions near an electron emitting cathode where low energy electrons are captured by electronegative molecules.

"Nanotubes" are graphitic microtubule structures of atomic thickness, of the order of 10 Å inside diameter, which have enormous tensile strength. Nanotubes are named for their cylindrical hollow form with namometer size diameters. They may have single or multi-walled structure.

"Schottky emission" is the enhancement of thermionic emission from a cathode resulting from the application of a moderate accelerating electric field $\sim 10^5$ V/cm to $\sim 10^6$ V/cm. The electric field lowers the barrier height, and hence decreases the effective work function. The electric field is not high enough to sufficiently thin the barrier width, so that field emission is not an appreciable part of the emission at moderate electric fields.

"Thermionic emission" is the liberation of electrons from a heated electrical conductor. The electrons are essentially boiled out of a material when they obtain sufficient thermal energy to go over the potential energy barrier of the conductor. This is somewhat analogous to the removal of vapor from a heated liquid as in the boiling of water.

"Thermo-field assisted emission" involves thermionic emission in the presence of a moderate to high electric field so that it includes the realms of both Schottky emission and field emission. At high electric fields, the emission rate is much higher than just from Schottky emission as the barrier is not only decreased in height, but also in width.

"Thermoplastic" refers to materials with a molecular structure that will soften when heated and harden when cooled. This includes materials such as vinyls, nylons, elastomers, fuorocarbons, polyethylenes, styrene, acrylics, cellulosics, etc.

"Torr" is a unit of pressure, where atmospheric pressure of 14.7 lb/in$^2$=760 Torr=760 mm of Hg.

"Whisker" is the generic term used herein for a microprotrusion or asperity on the surface of a material with a large aspect ratio of height to tip radius.

"Work function" is the minimum energy needed to remove an electron at 0 K from a metal. At higher temperatures, the work function for most electrons does not differ appreciably from this low temperature value. More rigorously, the work function is the difference between the binding energy and the Fermi energy of electrons in a metal.

SUMMARY OF THE INVENTION

There are many aspects and applications of this invention, which provides techniques applicable individually or in combination as an actuator, for motion control, and for positioning. The broad general concept of this invention relates to the actuation, motion production and control, and positioning resulting from the forece due to electron, ion, and neutrals in electric fields. The instant invention can perform dynamic motion control over a wide range of dimensions from the nano-range, through the micro-range, through the mini-range to the macro-range in a broad scope of applications from micro-electro-mechanical systems (MEMS) as in optical switching to macro-positioning. The signal bandwidth is unparalled, and can range from nanoseconds to static. Motorless linear motion, angular deflection, and continuous rotation are achieved without recourse to magnetic fields thus eliminating the need for coils. Furthermore, the instant invention permits less costly and greater ease of manufacture while providing well-defined motion and position control.

It is a general object of this invention to provide a dynamic system for motion control.

Another general objective of this invention to provide a positioning system.

Another object of this invention to provide an actuator.

It is a general object of this invention to provide a dynamic switching system for electromagnetic radiation beams that operates by reflection.

Another objective of this invention is to provide the motive force for an optical switch.

Another general object of this invention is to produce motion in any direction as well as in the reverse direction.

Another aspect of the instant invention is to produce motorless linear motion.

Another objective of this invention is to cause angular deflection.

An object of the invention is to produce continuous rotation.

An objective of this invention is to produce rotation with the ability to stop.

An object of the invention is to move a specimen under a microscope.

Another objective of this invention is to produce dynamic interferometry to go from constructive to destructive interference.

Another object of the instant invention is to produce a dynamic diffraction grating in which the grating spacing is varied and hence shift the wavelength selection.

Another object is to provide a motive force for an atomic force microscope.

Another objective is to damp reading and writing head oscillations over optical or magnetic disks.

Another object is to provide for active control of reading and writing heads over optical or magnetic disks.

Another objective is to provide for adaptive optics telescopes which compensate for aberation due to atmospheric fluctuations.

Other objects and advantages of the invention will be apparent in a description of specific embodiments thereof, given by way of example only, to enable one skilled in the art to readily practice the invention singly or in combination as described hereinafter with reference to the accompanying drawings.

DETAILED DESCRIPTION OF THE PRESENTLY PREFERRED EMBODIMENTS

As is described here in detail, the objectives of the instant invention may be accomplished by any of a number of ways separately or in combination, as taught by our invention.

Figure 1:
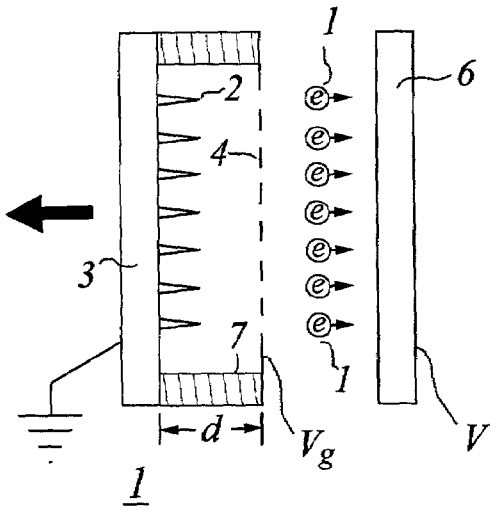
FIG. 1 is a cross-sectional view of a fundamental motive device which produces a force by the emission of electrons.
Figure 4:
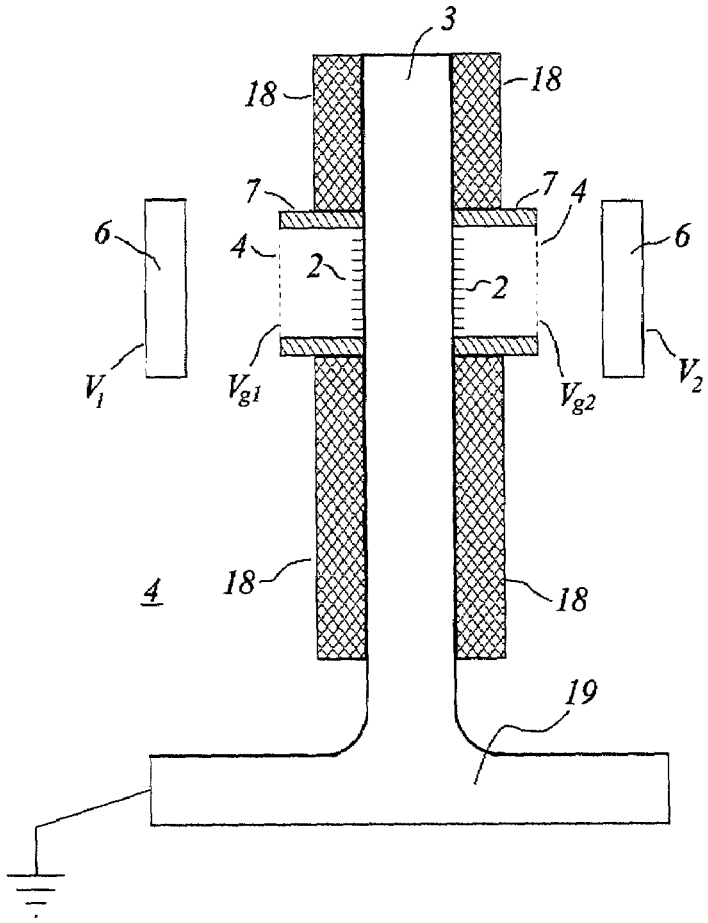
FIG. 4 is a cross-sectional view of an angular deflection or linear motion device depending on whether the bottom support is fixed or free to move.
Figure 6:
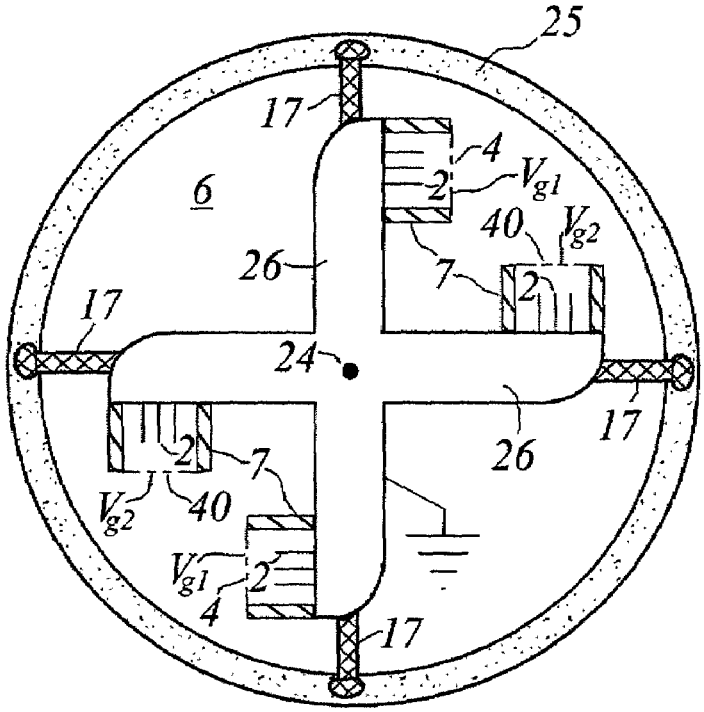
FIG. 6 is a cross-sectional view of a rotational device which moves in a ring of ferrofluid which provides braking action when a magnetic field is applied.

FIG. 1 shows a fundamental motive device 1, which in this case produces a force by the emission of electrons 1 from whiskers 2 on an electrode 3 that serves as cathode. Upon leaving the whiskers 2, the electrons 1 cross the gap d to pass through a grid 4 at voltage $V_g$ to enter a region 5, and then are collected at the ultimate anode collector plate electrode 6 at voltage $V \geqq V_g$. When $V=V_g$, region 5 is field free. A dielectric 7 supports the grid 4 and electrically isolates the grid 4 from the electrode 3. The configuration of the grid 4 at fixed separation d from the electrode 3 serves to maintain an unchanging macroscopic electric field as motion is imparted to electrode 3. Otherwise the cathode-anode gap would change, requiring a modulation of the applied voltage to control the motive force. A repulsive force is produced to the left as shown by the arrow and as explained by the following analysis. If the device 1 operates in the purely field emission mode, reversing the voltages will stop the emission and there will be no emission force $F_i$. Thus a spatially reversed similar device 1 is needed for reverse motion to the right, such as illustrated in FIGS. 4, 6, etc.

1. Electric Field Enhancement

The whiskers 2 enhance the electric field near their tips. The electric field enhancement at the tip of the whisker is $$\beta \sim h/r \tag{1.1}$$

to a good approximation, independent of the shape of the whisker (e.g. hemispherically capped whisker, cone, spheroid, etc.). As long as the whisker height is small compared with the gap d, the electric field enhancement is independent of the size of the whiskers and just depends on the aspect ratio h/r. Thus two whiskers of widely different dimensions may have the same enhancement if $h/r=h'/r'$.

The enhanced microscopic electric field at the tip of a whisker is $$E_{mic}=\beta E_{mac} \tag{1.2}$$

where $E_{mac}$ is the macroscopic electric field that would be present at the tip location if the whisker weren't there. In the case of a nearly uniform macroscopic field such as shown in FIGS. 1, 2, 4, 6, 7, 10 and 11, $$E_{mac}=V_g/d. \tag{1.3}$$

The microscopic field falls off rapidly, so that at a distance ≧10 r (10 tip radii), the microscopic field differs by less than 1% from the macroscopic field.

For very close whisker separations, the enhancement decreases. A large density (close separtion) of sharp whiskers is desirable to increase the total emission current as long as the separation between whiskers $$\delta>10r. \tag{1.4}$$

At separations between whiskers greater than 10 tip radii, the enhanced microscopic field of each whisker falls off quickly enough with distance that it hardly affects the microscopic field of an adjoining whisker. Within the approximation δ>10 r, the total current is approximately proportional to the total number of sharp whiskers. One may understand why too high a density of whiskers is disadvantageous by noting that in the limit of contiguous whiskers of the same height, there is no enhancement of the electric field.

2. Negative Particle Emission Positioning and Motion Control

Let us first consider the emissive repulsive reaction force, $F_e$, on a cathode due to the emission of electrons so that we may better understand the various trade-offs that may be undertaken in the choice of parameters for the motive device 1.

$$F_e=\frac{dp}{dt}=\frac{d}{dt}(Nmv)=mv\left(\frac{dN}{dt}\right)=mv\left(\frac{I}{e}\right), \tag{2.1}$$

where p is the momentum of the emitted electrons, m is the mass of an electron, e is the charge of an electron, N is the number of emitted electrons which have attained velocity v as they emerge beyond the grid, and I is the emission current. The kinetic energy gained by the electrons as they emerge from the grid is equal to the potential energy given up in the electric field:

$$\frac{1}{2}mv^2=eV_g \Rightarrow v=\left[\frac{2eV_g}{m}\right]^{1/2}, \tag{2.2}$$

where $V_g$ is the grid voltage. Substituting eq. (2.2) into eq. (2.1) we have the emissive force on the cathode:

$$F_e=m\left[\frac{2eV_g}{m}\right]^{1/2}\left(\frac{I}{e}\right)=I\left[2V_g\left(\frac{m}{e}\right)\right]^{1/2}. \tag{2.3}$$

Eq. (2.3) implies that ions would exert a larger force due to their larger m/e ratio. Please note that the derivation of eq. (3) is general enough that a current I of negative ions of charge e and mass m from the (negative) electrode 3 could also be carried predominantly by induced negative ion emission (cf. Sec. 3). Similarly, the geometry and largely uniform electric field shown in FIG. 1 is only illustrative. Eq. (2.3) gives the emissive force for any shape electric field, and even in the presence of space charge in the accelerating region. Electron and negative ion emission are presented as preferred embodiments of our invention; as is the grid structure.

Using eq. (2.2), the power expended $P_e=IV_g$ to produce the emissive force is $$P_e=F_e\langle v\rangle=F_e\left(\frac{1}{2}v\right)=\frac{1}{2}F_e\left[\frac{2eV_g}{m}\right]^{1/2}, \tag{2.4}$$

where (v) is the average velocity. Eq. (2.4) says that to reduce the power expenditure in producing a given force, we want the charge carrier to have as large a mass to charge ratio as possible, and to make $V_g$ as small as possible.

Let us look at some sample parameters to get an indication of the magitude of the force that is readily possible and the necessary power. The energy loss can be quite small as the power need be applied for only a fraction of a second. For an electron current of 10 Amperes with $V_g$=40 Volts, $F_e$=21 dynes which is sufficient for many applications. The mass to charge ratio of electrons is only $5.6\times10^{-12}$ kg/C. Negative ions can easily have mass to charge ratios that are more than 60,000 times higher than this. Thus negative ions would produce a force of $F_e$>500 dynes at the same voltage, one tenth the current, and a power requirement of only 40 Watts. As shown in Sec. 7, the capacitive electrostatic force is only about 4.4 dynes for comparable parameters.

3. Negative Ions

Since an important operating mechanism utilizes negative ions, let us briefly gain an insight into them. A negative ion is a neutral atom or molecule which has orbitally captured one or more electrons. The electron affinity of a given kind of atom or molecule is a function of both the species, and the medium it is in. It is equivalent to the ionization potential for removing the electron from the negative ion. The noble gases such as He, Ne, and Ar have a filled outer electron shell, are chemically inert, and do not form negative ions. Most atoms have positive affinities. The halogens such as fluorine, chlorine, bromine, and iodine which require only one additional electron to fill their valence shell, have the largest electron affinities for making negative ions.

Fluorine is very electro-negative, having one of the strongest electron affinities for making negative ions. However because of fluorine's toxicity and corrosiveness, it is generally incorporated as part of less active molecules like $SF_6$ for electron capture. Oxygen also easily makes a negative ion—even double charged. But negative oxygen is not stable in the gas phase, although doubly charged O—is stable in solution illustrating that the ability to form negative ions is also a function of the medium the atom is in.

For production of positive ions, the maximum ionization cross-section is at about 10 times the ionization potential. The ionization cross-section falls steeply below this value, and falls slowly above this value. There is no ionization below the ionization potential, and not much ionization up to 5 times the ionization potential. So for small devices for which the instant invention is exceptionally suited, high electric fields are produced while operating at low voltages. So in this case, there are few if any positive ions, with mainly free electrons and negative ions.

One method of production of negative ions is by the field or thermionic emission of electrons from the cathode at low voltage. Bear in mind that with small spacing d, a large electric field can be created even with small voltage. At these low voltages, and polarization of molecules in the high electric field gradient of the whiskers (refer to Sec. 5), the emitted electrons can attach to electro-negative gas molecules such as $SF_6$. This is referred to herein as induced negative ion emission.

Figure 2:
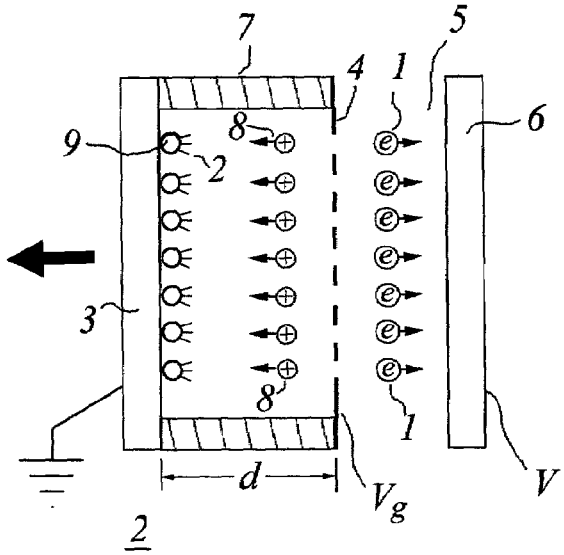
FIG. 2 is a cross-sectional view of another basic motive device which produces a force by the collection of ions and electrons.

FIG. 2 is a cross-sectional view of another basic motive device 2 which in this case produces a force $F_i$ to the left (cf. arrow) by the collection of electrons 1 and positive ions 8 produced for example by a corona discharge in a liquid or gas medium, where there are few if any negative ions. As an alternate way of introducing whiskers 2 inside the device 2, wires 9 upon which whiskers are grown (cf. Mario Rabinowitz, Emissive Flat Panel Display with Improved Regenerative Cathode, U.S. Pat. Nos. 5,697,827, 5,764,004, and 5,967,873), are attached to electrode 3. A dielectric 7 of length d supports the grid 4 and electrically isolates the grid 4 at voltage $V_g$ from electrode 3. An ultimate collector plate electrode 6 is at voltage $|V| \geqq |V_g|$ When $V=V_g$, region 5 is field free. The configuration of the grid 4 at fixed separation d from electrode 3 serves to maintain an unchanging macroscopic electric field as motion is imparted to electrode 3 due to the force of the ions as can be seen from the analysis which follows in Sec. 4. With $V_g$ positive, the force is to the left as shown by the arrow. A spatially reversed motive device 2 could be used for reversed motion to the right, such as illustrated in FIGS. 4, 6, etc.

4. Positive Ion Pressure Production

By means of a corona discharge a partially ionized medium may be created with predominantly positive ions, electrons, and few if any negative ions. The medium may be a liquid, or a gas at moderate to above atmospheric gas density. We shall concentrate on the frictional momentum transfer by the positive ions to the ambient gas. Momentum transfer by electrons in the oppositve direction is negligible due to their small mass. Momentum transfer by the negative ions in the oppositve direction is negligible due to their scarcity. In equilibrium, the body force (force/volume) on the ions due to an electric field E is balanced by the gradient in pressure P. In the one-dimensional case:

$$\frac{dP}{dx} \approx \rho E, \tag{4.1}$$

where for small ion currents the viscous losses are negligible, and ρ is the charge density of the ions. This tells us that the pressure is greatest where the electric field is greatest.

The ion current density j is $$j = \rho v = \rho(\mu E) \Rightarrow \rho = \frac{j}{\mu E}, \tag{4.2}$$

where μ is the mobility. Substituting eq. (4.2) into (4.1):

$$\frac{dP}{dx} = \left(\frac{j}{\mu E}\right)E = \frac{j}{\mu} \Rightarrow \int_{P_o}^{P} dP = \int_0^x \frac{j}{\mu} dx. \tag{4.3}$$

We can do a direct integration of eq. (4.3) since j is independent of x, and μ is a slowly varying function of E/P making it to a good approximation independent of x:

$$\therefore P - P_o = \frac{jx}{\mu}. \tag{4.4}$$

From eq. (4.4) we note that to produce a high pressure differential we want a low mobility μ, and hence heavy ions. We also want a large current density j, and hence we want the ions to be multiply ionized if possible. Thus the total force due to the electric field acting on the positive ions is $$F_i = \oint P \cdot dA = \int \nabla P \cdot d\Omega \approx \frac{Id}{\mu}, \tag{4.5}$$

where I is the ion current, and dΩ is a volume element.

Even though only a small fraction of the neutral atoms and molecules are ionized, the space charge conditions determine the electric field configuration and the ion flow. For this one-dimensional case, by eq. (4.2) Poisson's equation becomes $$\frac{dE}{dx} = \frac{\rho}{\varepsilon} = \frac{j}{\varepsilon\mu E}. \tag{4.6}$$

Integrating eq.(4.6) and substituting eq. (4.4):

$$\int_{E_o}^{E} E dE = \int_0^x \frac{j}{\varepsilon\mu} dx \Rightarrow P - P_o = \frac{jx}{\mu} = \frac{1}{2}\left[E^2 - E_o^2\right]. \tag{4.7}$$

Since E=−dV/dx, we can integrate eq. (4.7) to get V:

$$V = -\int_0^x \left[E_o^2 + \frac{2jx}{\varepsilon\mu}\right]^{1/2} dx = \frac{-\varepsilon\mu}{3j}\left[\left(E_o^2 + \frac{2jx}{\varepsilon\mu}\right)^{3/2} - E_o^3\right]. \tag{4.8}$$

Considering the case where the $E_O$ terms are negligible, and substituting eq. (4.4) into (4.8):

$$V = \frac{-\varepsilon\mu}{3j}\left(\frac{2jx}{\varepsilon\mu}\right)^{3/2} = -\left(\frac{8jx^3}{9\varepsilon\mu}\right)^{1/2} = -\left[\frac{8x^2}{9\varepsilon}(P - P_o)\right]^{1/2}. \tag{4.9}$$

The power $P_i$ needed for the ions to produce the pressure differential by eq. (4.9) is $$P_i = IV = -jA\left(\frac{8jx^3}{9\varepsilon\mu}\right)^{1/2} = -\left(\frac{8I^3x^3}{9A\varepsilon\mu}\right)^{1/2} = -I\left[\frac{8x^2}{9\varepsilon}(P-P_o)\right]^{1/2}. \quad (4.10)$$

Interestingly, we can eliminate the ionic current I from $P_i$ by using eqs. (4.8) and (4.4)

$$P_i = IV \approx \frac{-\varepsilon\mu I}{3j}\left(\frac{2jx}{\varepsilon\mu}\right)^{3/2} = \frac{-\varepsilon\mu A}{3}\left(\frac{2jx}{\varepsilon\mu}\right)^{3/2} = \frac{-\varepsilon\mu A}{3}\left(\frac{2(P-P_o)}{\varepsilon}\right)^{3/2}. \quad (4.11)$$

In vacuum, only emitted electrons participate in the mechanism for the motive force. As soon as a medium is introduced, a number of mechanisms may be at work simultaneously. For example, the positive ion space charge electric field at the cathode can make a sizable contribution to electron field emission, as well as producing a pressure of its own.

Figure 3:
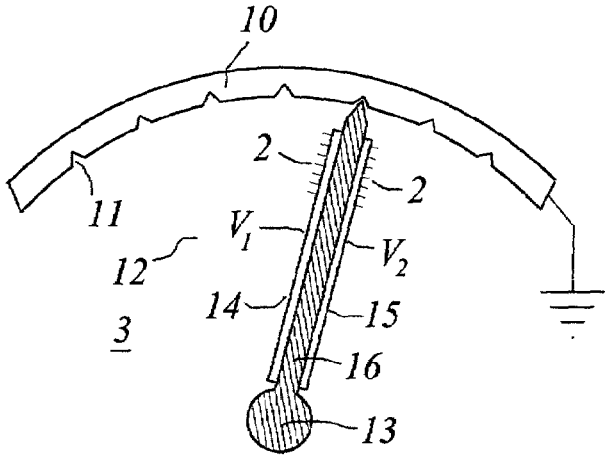
FIG. 3 is a cross-sectional view of an angular deflection device which moves to a given detent position.

FIG. 3 is a cross-sectional view of an angular deflection device 3 which moves to a given detent position. Shown is an indented track 10 with detent positions 11 operating in a medium 12 so that the device may rotate about the pivot axis 13 in either direction with the application of a voltage $V_1$ to conducting arm 14 and/or $V_2$ to conducting arm 15 to produce a large microscopic electric field with a high field gradient at the whiskers 2 so that the device 3 may operate by any of the physical mechanisms described in the body of the specification. The conducting arms 14 and 15 are separated by a dielectric 16. There is a flexible dielectric protrusion 17 at the top of the dielectric 16 which fits into the detent positions 11.

5. Neutral Dielectric Polarization Positioning and Motion Control

For completeness, we should consider yet another mechanism which can be utilized to produce a motive force. On any size scale, as soon as a medium other than vacuum is utilized, new effects in addition to electron flow enter in. Let us next examine another mechanism for positioning and motion control. The force in the emission case results from the flow of charged particles. It is also possible to exert a force when the medium is a neutral dielectric with a permanent dipole moment D, and a polarizability α. The potential energy $V_p$ of a neutral particle in this field is $$V_p = -DE - \frac{1}{2}\alpha E^2. \quad (5.7)$$

The polarization force is—the gradient of $V_p$ in eq. (5.7)

$$F_p = -\nabla V_p D\nabla E + \frac{1}{2}\alpha\nabla E^2 = D\nabla E + \alpha E\nabla E. \quad (5.8)$$

Eq. (5.8) says that when the medium is a neutral dielectric, it is attracted to a region of increased electric field, provided that its dielectric constant is greater than that of the surrounding area. The force on the dielectric medium is proportional to the gradient of the electric field for the permanent dipole moment term. It is proportional to the gradient of the electric field squared for the induced dipole moment term; or equivalently, proportional to the electric field times the gradient of the electric field The polarization that the field produces on both permanent and induced polar moments is proportional to the electric field strength. The force on the dielectric medium is proportional to the product of the electric field strength and the degree of polarization, resulting in the quadratic dependence. In a uniform field, the field exerts equal and opposite forces on the polarized particle resulting in no net force. With a field gradient, the net force on the particle is always toward the increasing gradient independent of the direction of the field. This is also true for an alternating field, as the polarized particle simply rotates or changes the direction of its induced polarization to accommodate the changing field. So the device can operate on either dc or ac power. Note that the grid structure shown in the various embodiments of the instant invention is also important for the neutral molecules motive force. It was clear that the grid structure is important to the electron and ion motive force because it maintains a given electric field independent of the motion. This is also true of neutral molecule motive force since maintaining a given electric field serves to maintain a given gradient of the electric field. Both for neutrals and positive ion pressure of Section 4, the force and the pressure is greatest where the electric field is greatest.

There are similarities between this mechanism and the outward electrostrictive pressure of a dielectric in a capacitor as both involve polarization of the dielectric. Just as the repulsive electrostrictive force can exceed the attractive capacitive electrostatic force, so can the polarization force given by eq. (5.8) when the field gradient is sufficiently strong. The body or volume force (force/volume) on a dielectric is $$F/\Omega = \rho E = \frac{1}{2}E^2\nabla\kappa + \frac{1}{2}\nabla\left[E^2\mu\frac{d\kappa}{d\mu}\right], \quad (5.9)$$

where Ω is the volume, ρ is the charge density, κ is the dielctric constant, and μ is the mass density. The third term is the electrostrictive term.

The power disipated is related to the dot product of the force given by eq. (5.8) and the mean flow velocity <v>:

$$P_p = F_p \cdot \langle v\rangle = [D\nabla E + \alpha\nabla E^2]\cdot\langle v\rangle. \quad (6.0)$$

Figure 10:
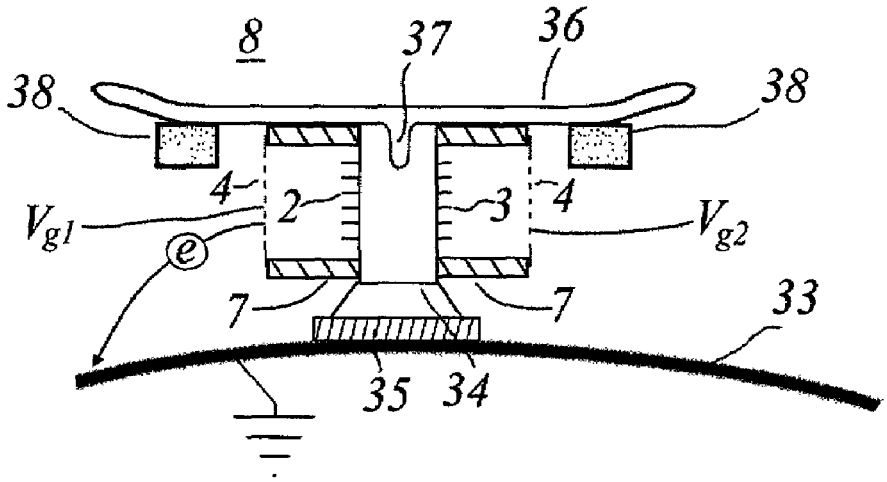
FIG. 10 is a cross-sectional view of a bi-directional linear and rotational motion device on a rail, such as might be used for moving a specimen around under a microscope to view its different parts.

FIG. 4 is a cross-sectional view of an angular deflection or linear motion device 4 depending on whether the bottom support is fixed or free to move. Shown are the whiskers 2 on the electrode 3 with grids 4 at voltages $V_{g1}$ and $V_{g2}$, supported by dielectrics 7. Ultimate collector plate electrodes 6 are at voltages $|V_1| \geqq |V_{g1}|$ and $|V_2| \geqq |V_{g2}|$. To illustrate a specific application, mirrors 18 are mounted on electrode 3 so that device 4 can operate as an optical switch, by beaming light or other electromagnetic radiation to a switching matrix. For angular deflection, the bottom support as shown is a cantilever structure 19; however, it could also be pivoted as in FIG. 3. As a linear motion device it could move on a rail or on the ground as illustrated in FIG. 10.

6. Temperature Related Pressure Effects

An elevation of temperature and temperature gradients with concomitant pressure elevation and pressure gradients are produced by power dissipation in the many physical motive mechanisms. So it is appropriate to briefly discuss this effect which although it has subtle ramifications simply amounts to the fact that if one side of an electrode is warmer than the other, particles will recoil with greater momentum transfer from the warmer side creating a pressure differential. For low ambient pressure i.e. low gas density n, where the particles have long mean free paths, differences in temperature T and pressure P are easier to maintain, and the net force is proportional to the macroscopic area A of the electrode (e.g. electrode 3 in FIG. 1).

Low Ambient Pressure

For equal number density of molecules on both sides of the electrode, i.e. for $n_2=n_1$:

$$\frac{P_2}{P_1}=\frac{n_2T_2}{n_1T_1}=\frac{T_2}{T_1}, \tag{6.1}$$

The net force in this case is $$F=A(P_2-P_1). \tag{6.2}$$

High Ambient Pressure

However as the ambient pressure is increased, an increase in temperature reduces the gas density over the interior surface of the electrode. This reduces the collision frequency with the electrode and hence the pressure exerted on it making the pressure in this interior region of the electrode roughly equal on both sides. This leaves only a strip of width w and length l around the perimeter of the electrode where eq. (6.1) applies. The net force in this case is $$F=wl(P_2-P_1), \tag{6.3}$$

where wl<<A. Near the edges of the electrode the temperature differential decreases since the high gas collision frequency reduces the temperature on the warm side to $T'_2$ and increases it to $T'_1$ on the cool side maintaining the relationship $T'_2>T'_1$. Even if $T'_2/T'_1=T_2/T_1$, the purely temperature related pressure effect goes away as $w\rightarrow 0$.

Figure 5:
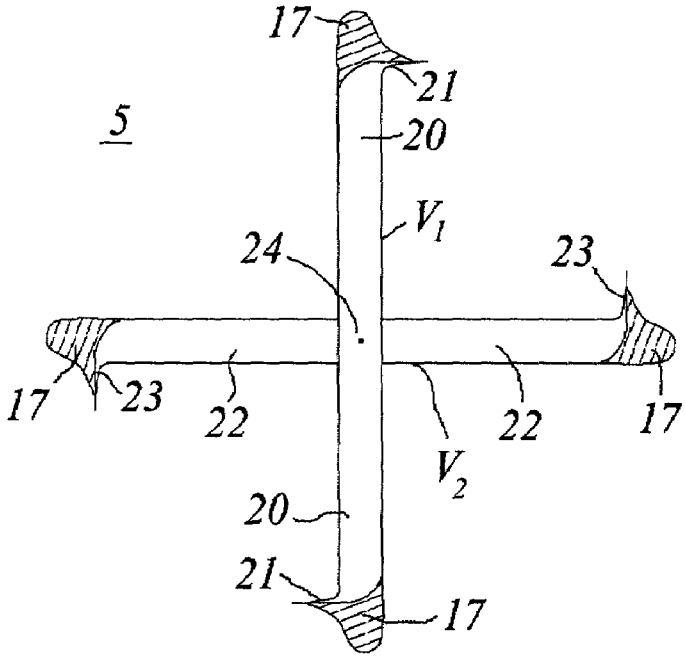
FIG. 5 is a cross-sectional view of a rotational device which can operate in either direction.

FIG. 5 is a cross-sectional view of a rotational device which can operate in either direction due to opposed direction arms. Shown is a vertical conducting arm 20 with right angle sharp pointed tips 21 pointing to the right at the top, and pointing to the left at the bottom for producing counter-clockwise rotation when a voltage $V_1$ is applied to it. A horizontal conducting arm 22 with right angle sharp pointed tips 23 pointing up at the right, and pointing down at the left produces clockwise rotation when a voltage V2 is applied to it. More arms may be used to apply greater force. The arms are supported by a common axis 24 of rotation, and separated by a dielectric (not shown) which is between them. A dielectric protrusion 17 is attached to the end of each arm to fit into a detent position as described in FIG. 3, or to move in a ferrofluid as described in FIG. 6. For operation as a rotary motor, the pointed tips would all point in the same rotational direction, i.e. all clockwise or all counter-clockwise.

FIG. 6 shows a rotational device 6 which moves in a ring of conducting ferrofluid 25 at voltage V, which provides braking and holding action on dielectric protrusions 17 to the conducting arms 26 when a magnetic field is applied to help stop the rotation and to hold the arms 26 in a fixed angular position. The whiskers 2 are electrically connected to the conducting arms 26 at ground potential and are electrically isolated by the dielectrics 7 from the grids 4 and 40. When a voltage $V_{g1}$ is applied to the grids 4, the arms 26 rotate in a counter-clockwise direction; and when a voltage $V_{g2}$ is applied to the grids 40, the arms 26 are caused to rotate clockwise. The arms 26 are supported by a rotation axis 24. A feedback circuit can be used to reduce the voltages to reduce the motive force, while at the same time applying a magnetic field to quickly brake the arms 26 to stop at a desired location. For operation as a rotary motor, the whisker tips would all point in the same rotational direction, i.e. all clockwise or all counter-clockwise. More arms may be used to apply greater force.

Figure 7:
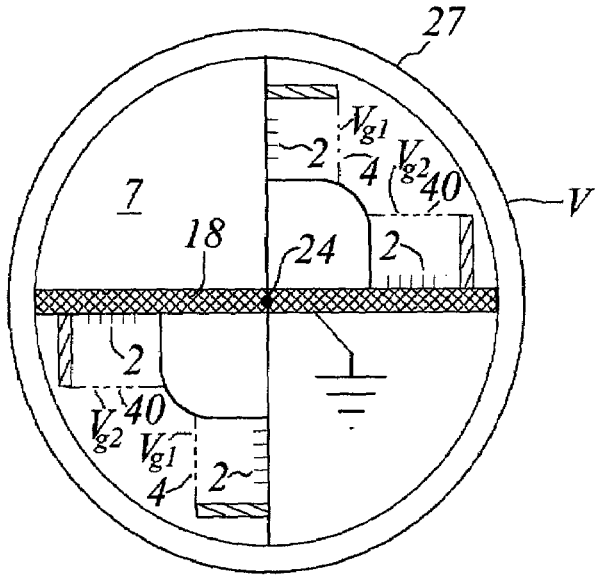
FIG. 7 is a center cross-sectional view of a rotational mirrored sphere in which portions are removed for the placement of pairs of bi-directional motive devices.

FIG. 7 is a center cross-sectional view of a rotational sphere 7 made of a transparent material in which portions are removed for the placement of pairs of bi-directional motive devices. The sphere 7 is inside a spherical shell 27 at voltage $|V|\geqq|V_g|$, where $V_{g1}$ is the voltage applied to the vertical pair of grids 4, and $V_{g2}$ is the voltage applied to the horizontal pair of grids 40 for counter-clockwise or clockwise rotation of the sphere 7 about axis 24. The whiskers 2 are attached to the sphere 7 and held at ground potential. Not shown because they are above and below the plane of this center cross-sectional view, are a similar set of pairs of bi-directional motive devices with grids etc. to produce rotational motion about an axis perpendicular to the plane shown, so that the rotational sphere 7 has two axes control. To illustrate a specific application, a mirror 18 whose plane is perpendicular to the plane shown, is embedded in the sphere 7. For operation as a rotary motor, the whisker tips would all point in the same rotational direction, i.e. all clockwise or all counter-clockwise. More motive devices may be used to apply greater force.

Figure 8:
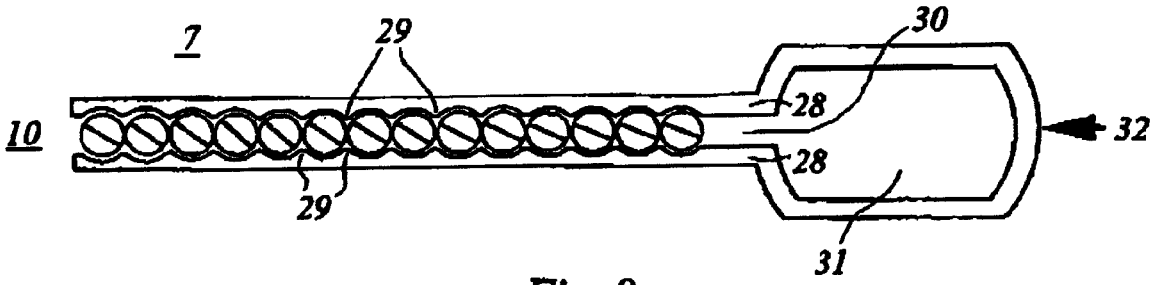
FIG. 8 is a cross-sectional view of an ensemble of rotatable spheres between two sheets which can clamp them in place, or release them for rotation.

FIG. 8 is a cross-sectional view of an ensemble 7 of individually rotatable spheres or cylinders (herein generally referred to as elements 10 for convenience) between two transparent elastomer sheets 28 which can clamp them to hold them in place, or release them for rotation. The rotatable elements 10 are situated in ridged cells 29 between the two elastomer sheets 28. For spherical or cylindrical elements 10, the ridged cellular structure 29 is conducive but not necessary to hold the elements 10 in grid position as an array. For short cylindrical elements 10 of disk shape, the ridged cells 17 are a valuable adjunct in maintaining the array structure and avoiding binding between the elements 10.

When rotation of the elements 10 is desired, the effect of the torque applied by the field can be augmented by injecting a fluid 30 from a plenum reservoir 31 by a pressure applying means 32 to expand the separation of the sheets 28. In addition to providing a means to pressure the elastomer sheets 28 apart, the fluid 30 acts as a lubricant to permit the elements 10 to rotate freely when being guided into the proper orientation by any of the motive forces described in the body of the specification.

The ridged cells 29 can be created in thermoplastic elastomer sheets 28 by heating the sheets 28 to a slightly elevated temperature and applying pressure with the elements 10 between the sheets 28. In the case of elements 10 of disk shape, the ridged cells 17 can be created on each sheet individually. This gives twice the height for the cells, when two such sheets are put together to hold the elements 10.

Figure 9:
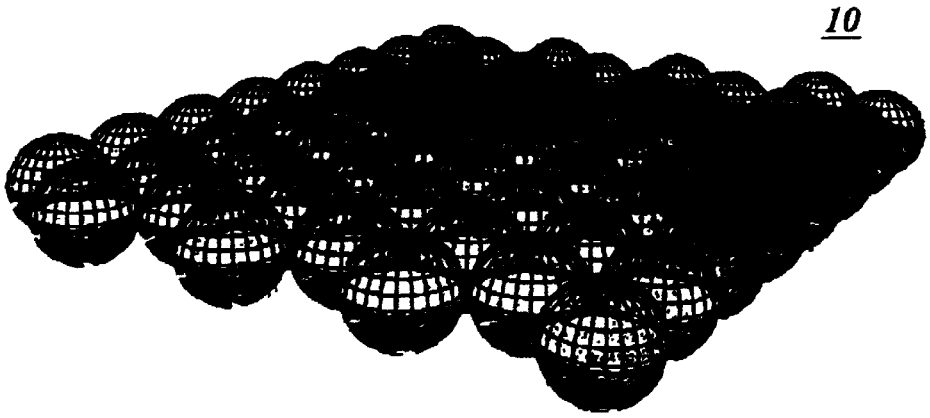
FIG. 9 is a perspective view of a two-dimensional array of rotatable spheres.

FIG. 9 is a perspective view of a two-dimensional array of the rotatable elements 10 which can be used for a wide range of applications such as optical switching, solar concentrator, projection illuminator, dynamic interferometery, dynamic diffraction grating, adaptive optics, and large aperture actively reflecting telescope, etc.

FIG. 10 is a cross-sectional view of a bi-directional linear and rotational motion device 8 on a rail 33 at voltage $|V| \geqq |V_g|$. Device 8 might be used for moving a specimen around under a microscope to view its different parts. Electrons are emitted from the whiskers 2 and pass through the grid 4 at voltage $V_g$, supported by the dielectric 7, are shown being collected at the rail 33 at voltage V. Of course, another motive force utilizing ions and/or neutrals as taught in the instant invention may also be used. The base 34 is supported on a dielectric 35 which is free to move on the rail 33. A specimen holding dish 36 is mounted on a pivot 37 which permits rotation of the disk when torque producing devices 38 are activated as described in conjunction with FIG. 6.

Figure 11:
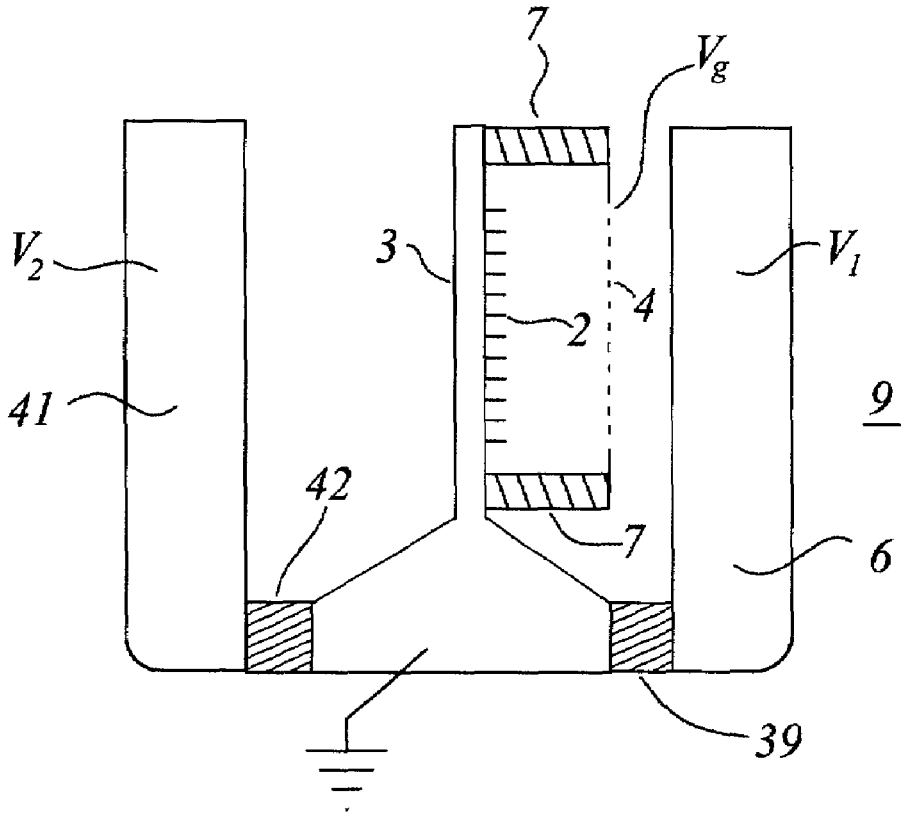
FIG. 11 is a cross-sectional view of an angular deflection device which is shown to produce a torque by a combination of momentum recoil and electrostatic attraction working in unison.

FIG. 11 is a cross-sectional view of an angular deflection device 9 which is shown to produce a deflection force by a combination of momentum recoil and capacitive electrostatic attraction. Shown are whiskers 2 on an electrode 3 at ground potential, and grid 4 at voltage $V_g$, supported by the dielectric 7, and ultimate collector plate electrode 6 at voltage $|V_1| \geqq |V_g|$ electrically isolated by dielectric 39. A second plate 41 at voltage $V_2$, on the left of electrode 3, is electrically isolated by dielectric 42. This left side is controlled by an electrostatic capacitive force between plate 41 and electrode 3, while the right side is controlled by any of the many motion control forces as taught in the instant invention.

7. Comparing Emissive Force with Capacitive Electrostatic Force

The attractive force, $F_c$, due to the electrostatic field between capacitor plates is $$F_c = \frac{1}{2}\varepsilon E^2 A = \frac{1}{2}\varepsilon\left[\frac{V}{d}\right]^2 A, \tag{7.1}$$

where $\epsilon$ is the permittivity of the space between the plates, E is the macroscopic electric field between them, V is the voltage across them, and d is the gap between the plates. For air, $\epsilon \sim 8.85\times10^{-12}$ Farad/m, with V=100 Volts, $d=10^{-1}$ cm, and $A=10^2$ cm$^2$, we find $F_c$=4.4 dynes. This is a relatively small force, and shows that the electrostatic force is only dominant at high voltages when d is comparable for the different mechanisms.

Contrasting Emissive and Electrostatic Forces

Let us contrast the capacitive attractive force, $F_c$ in eq. (7.1), with the emissive force $F_e$ as given by eq. (2.3). For comparison with $F_e$, let the plates have the same gap d as between the grid and the cathode, with the same voltage $V_g$ between them so that $E=V_g/d$. Thus $F_e>F_c$ when $$\frac{F_e}{F_c} = \frac{m\left[\frac{2eV_g}{m}\right]^{1/2}\left(\frac{I}{e}\right)}{\frac{1}{2}\varepsilon E^2 A} = \frac{I\left[2V_g\left(\frac{m}{e}\right)\right]^{1/2}}{\frac{1}{2}\varepsilon A\left[\frac{V_g}{d}\right]^2} > 1 \tag{7.2}$$

Eq. (7.2) implies that the emissive force is greater than the capacitive force if $$V_g < \left[\frac{2Id^2}{\varepsilon A}\right]^{2/3}\left[\frac{2m}{e}\right]^{1/3} = \left[\frac{2jd^2}{\varepsilon}\right]^{2/3}\left[\frac{2m}{e}\right]^{1/3}, \tag{7.3}$$

where j is the macroscopic current density in the emissive device. This means that there are a range of parameters for which the emissive device of the instant invention gives greater forces than a corresponding capacitive device.

Practicality of Emissive Force

Let us illustrate that the field emission electron emissive force dominates for sensible parameters, not just for extremely small nano-parameters and devices. It is thus well-suited for the nanometer to the decimeter range. We note that for $d=10^5$ Å$=10^{-5}$ m, $j=10^3$ A/cm$^2=10^7$ A/m$^2$, with $e=1.60\times10^{-19}$ Coulomb, $m=9.11\times10^{-31}$ kg, and $\epsilon=8.85\times10^{-12}$ Farad/m for vacuum and air eq.(6) says that for $V_g \leqq 82$ volt, the electron emissive force is dominant. For a voltage, $V_g$=40 volt, this gives $E_{mac}$=40 volt/$10^{-5}$ m=$4\times10^6$ volt/m=$4\times10^4$ volt/cm. To achieve sufficient field emission we need a microscopic electric field $E_{mic}>10^9$ volt/m=$10^7$ volt/cm, which requires an easily achieved enhancement factor of $\beta>250$. $E_{mac}$ is well below the electrical breakdown field (cf. Mario Rabinowitz, *McGraw-Hill Encyclopedia of Science & Technology* on Electrical Insulation in any of the editions from 1982–20002). Air at atmospheric pressure has an electrical breakdown field of $E_{bkn}\sim10^5$ V/inch=$4\times10^4$ V/cm for $d\sim10^{-1}$ cm; and for $d\sim10^{-3}$ cm=$10^5$ Å=$10^{-5}$ m, $E_{bkn}$ is considerably higher. In vacuum ($<10^{-5}$ Torr=$1.3\times10^{-3}$ Pascal) $E_{bkn}\sim2\times10^5$ V/inch=$8\times10^4$ V/cm for $d\sim10^{-1}$ cm; and for $d\sim10^{-3}$ cm=$10^5$ Å=$10^{-5}$ m, $E_{bkn}$ is considerably higher.

Negative ions readily have mass to charge ratios 60,000 times higher than for electrons. Since by eq. (7.3) $V_g$ is proportional to the cube root of the mass to charge ratio, $V_g$ would be 39 times higher for $F_e>F_c$ for the same parameters.

For small devices, when d is small or comparable to the electron mean free path in the ambient gas, then the motive device 1 operates effectively as if it were in vacuum. In this case operation at atmospheric pressure, is much the same as operation in vacuum. Air at standard temperature and 1 atmosphere pressure has a number density of molecules of $n\sim3\times10^{19}$ molecules/cm$^3$. The average spacing between molecules is $n^{-1/3}\sim3\times10^{-7}$ cm=30 Å. The mean free path of molecules is $\sim10^{-5}$ cm=1000 Å. The mean free path of electrons can be much higher than this.

Figure 12:
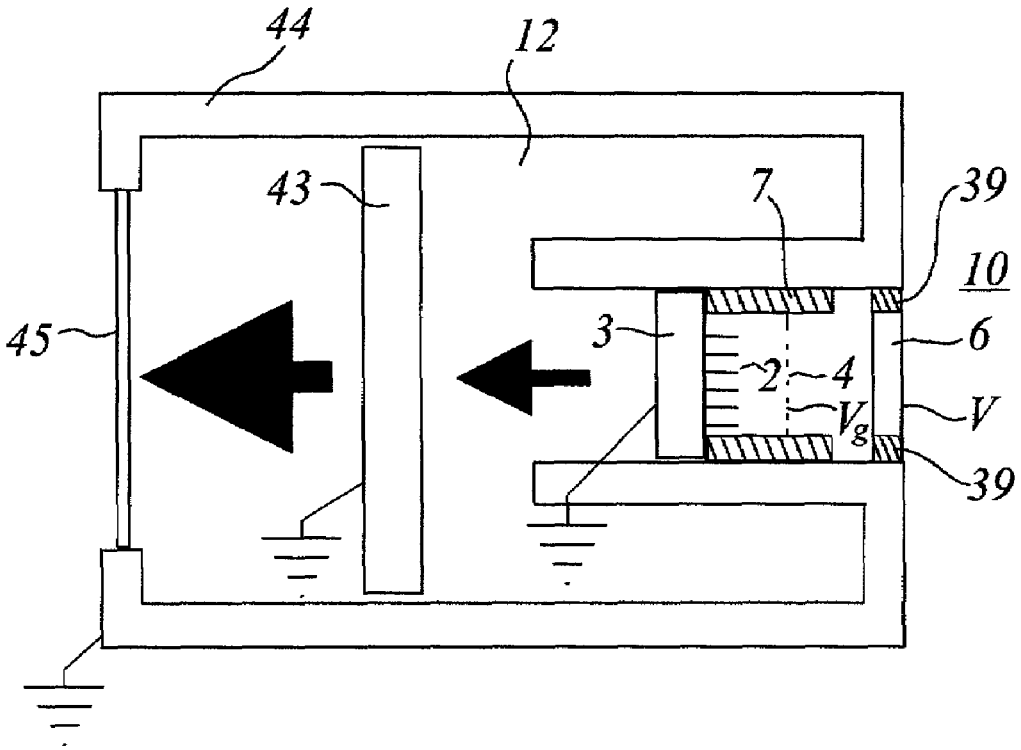
FIG. 12 shows a device for the creation of a large force from a small force by the hydrodynamic principle that when a small force acts on a small area, this produces an increased pressure, which acting via a fluid on a large area produces a large force. This device is ideally suited for dynamic interferometery in going from constructive to destructive interference.

FIG. 12 is a cross-sectional view of a force amplifying device 10 in which the creation of a large force (depicted by a large arrow) from a small force (depicted as a small arrow) is accomplished hydrodynamically by an increased pressure of a small force on a small area piston electrode 3 to act via a fluid medium 12 to produces a large force on the large area mirror 43 so that it can move toward or away from a light transmitting window 45. The small force acts on a small area electrode 3 covered with whiskers 2 to enhance the electric field produced by the voltage $V_g$ on the grid 4. The ultimate collector plate electrode 6 is at voltage $|V| \geqq |V_g|$. Both the electrode 3 and the plate 6 are electrically isolated by means of the dielectric 7. The small area electrode 3 acts like a piston to pressurize the fluid medium 12 by any of the mechanisms described in the specification. The large area mirror 43 also operates like a piston to maintain a seal for the fluid medium 12. The outer assembly 44 provides sealing cylinders, as shown, for the piston actions of electrode 3 and mirror 43. The motion of mirror 43 may be part of a dynamic interferometer which goes from constructive to destructive interference. Adjustment of the positon of this ordinary mirror 43 relative to half-silvered mirrors, as in a Michelson interferometer, causes light that is transmitted through and reflected by half-silvered mirrors to displace a system of fringes. Motion in the opposite direction to the arrows may be accomplished by decreasing the driving motive force, and simply letting the pressurized fluid medium 46 to the left of the mirror 43 cause motion to the left. Alternatively, bi-directional motive devices as in FIGS. 4 and 10 may be used.

This force amplifying device 10 is ideally suited for interferometer applications as the minor motion must be carefully controlled since a displacement of the minor by one-half a wave length causes each fringe to move from its original position to that formerly occupied by the next adjacent fringe. By counting the number of fringes which pass a fixed reference point the distance moved by the mirror can be measured to within a small fraction of a wave length of the light used. With this calibration, the wave length of rapidly changing unknown radiation can be measured. The device 10 can also be used as an extremely sensitive motion detector; or for many other purposes.

Figure 13:
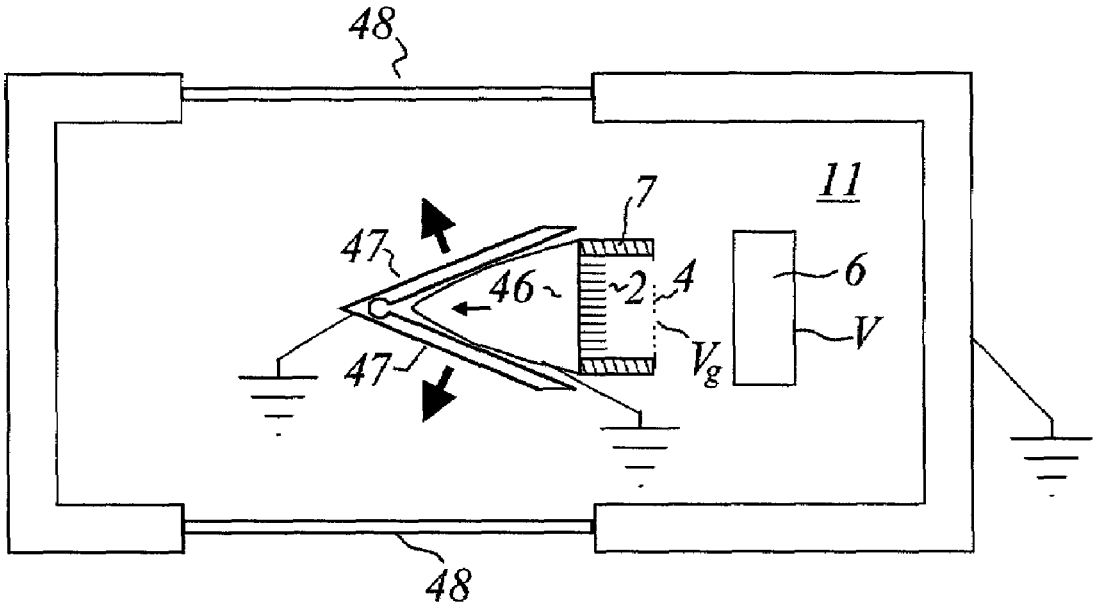
FIG. 13 shows a device for the creation of a large force from a small force by the principle of the wedge with application to fields such as optical switching.

FIG. 13 is a cross-sectional view of a force amplifying device 11 in which the creation of a large force (depicted by large arrows) from a small force (depicted as a small arrow) is accomplished by the principle of the wedge. Shown is a wedge-shaped cathode 46 covered with whiskers 2 to enhance the electric field produced by the voltage $V_g$ on the grid 4. The ultimate collector plate electrode 6 is at voltage $|V| \geqq |V_g|$. The grid 4 and the plate 6 are electrically isolated by means of the dielectric 7. Motion of the wedge 46 produces a large angular force on mirrors 47. The mirrors 47 may be used in optical switching; or for many other purposes in which anglular deflection is desired. Incident light may enter and reflected light may leave from the windows 48.

Figure 14:
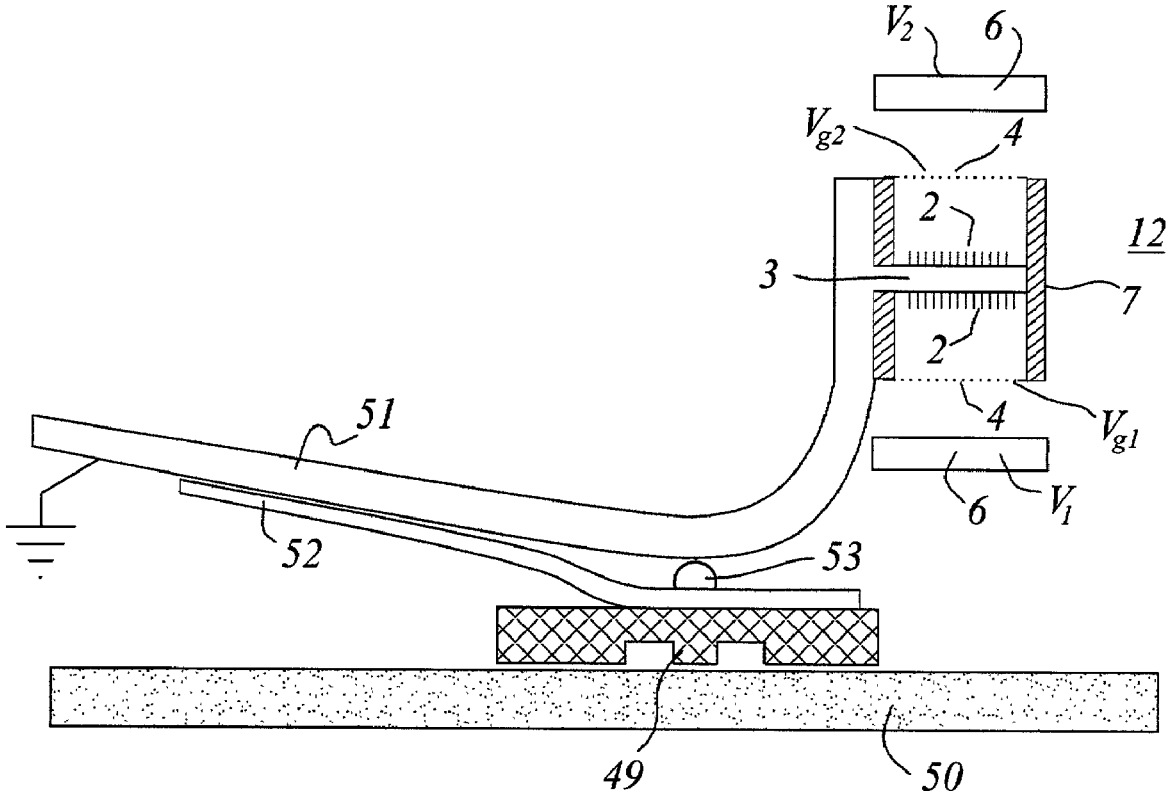
FIG. 14 shows motive force devices for control of reading and writing heads over optical or magnetic disks, such as to damp head oscillations .

FIG. 14 shows in cross-sectional side view, motive force devices 12 for control of a reading or writing head 49 over an optical or magnetic disk 50, for positoning control of the head 49 such as to damp head oscillations. Shown are an electrode 3 at ground potential, covered with whiskers 2, and separated from grids 4 at voltages $V_{g1}$ and $V_{g2}$. The ultimate collector plate electrodes 6 are at voltages $V_1$ and $V_2$ such that $|V| \geqq |V_g|$. The electrode 3 is part of an arm 51 to which is attached a spring 52 which is preloaded by the dimple 53. By the activating force mechanisms such as field emission, electron induced negative ion emission, and positive ions the devices 12, the head 49 may be positioned in the up or down location over the disk 50 as well as dampening out unwanted oscillations of the head 49.

DISCUSSION

Now that the instant invention has been described and the reader has a reasonable understanding of it, we can more clearly discuss its advantages with respect to other possible positioning and motion control mechanisms.

1. One of the most important advantages of the invention is related to ease of calibration, and response speed in producing a given desired motion or deflection. Electromagnetic systems are inherently slower in responding to an input signal because of self-inductance and mutual-inductance effects. Magnetic systems are inherently slower because of the time the magnetic field takes to diffuse into a conducting medium after it is applied. In terms of speed, the only competitor is the electrostatic capacitor force. However, it is intrinsically harder to calibrate because the force varies as $1/d^2$ as the capacitor plate separation changes. The book on Microactuators by Tabib-Azar shows the difficulty of this problem with the sharp $1/d^2$ falloff of the electrostatic force with plate separation dearly shown in his FIG. 2.2, p.40. This requires active and passive control methods which are very difficult and expensive to implement for micro and smaller devices which require very sensitive and small sensors.

Unlike such systems where the motive forces vary with the deflection, the fixed position grid in the instant invention allows the electric field and hence the motive force to be constant, independent of deflection, linear motion, or rotation. As shown in the analysis of Sec.7. the grid also allows the motive force to be greater than the attractive electrostatic capacitive force for all spacings between cathode plate and ultimate collector electrode. It is shown in Sec. 7 that this can be accomplished for practical operating parameters.

2. The analysis throughout the body of the specification indicates that the power requirements for the different mechanisms of the instant invention are moderate. The reason the power calculations were presented, was to enable not only a comparison of the different mechanisms with respect to power consumption, but also a comparison with other motive mechanisms, such as magnetic which require more power.

3. Electromagnets in general and electromagnetic motors in particular become quite inefficient as they are scaled down in size. Our invention is more amenable to miniturization such as required in nanotechnology.

4. One may raise a question regarding whisker lifetime. This is clearly a much less serious problem than for field emission flat panel displays. The instant invention is more robust in this respect. In field emission flat panel displays, even if whisker depletion occurs randomly it affects both pixel intensity and color creation. The instant invention is tolerant of random whisker depletion since the emitted current can be maintained constant by increasing the voltage to get the same force and hence same deflection. Calibration can be done with respect to current rather than voltage. Whisker regeneration in situ is possible as taught in Mario Rabinowitz, Emissive Flat Panel Display with Improved Regenerative Cathode, U.S. Pat. Nos. 5,697,827, 5,764,004, and 5,967,873. Thus the effects of whisker tip dulling can be mitigated both by regeneration and by separate control of emission.

5. The combination of a moderate electric field and thermionic emission by heating the emitting whiskers is called Schottky emission. The electric fields in this invention go from moderate to high. In the high field case of thermo-field assisted emission, the emission can greatly surpass Schottky emission. One substantive aspect of thermo-field assisted electron and negative ion induced emission, is that a given current can be sustained at substantially lower temperature than if the process were solely thermionic emission. The enhanced electric field greatly assists the thermionic emission. Concomitantly, the thermal aspect of moderately elevated temperature of the cathode assists emission due to the small field lowered barrier (effectively decreased work function) and tunneling through the barrier produced by a high electric field. Synergistically, the two aspects help each other in working together to produce notably higher emission rates than each alone. As taught in the immediately above-mentioned patents, the combination of thermal elevation and field elevation capability in the same cathode permits a novel regeneration of electric field enhancing whiskers on the cathode.

While the instant invention has been described with reference to presently preferred and other embodiments, the descriptions are illustrative of the invention and are not to be construed as limiting the invention. Thus, various modifications and applications may occur to those skilled in the art without departing from the true spirit and scope of the invention as summarized by the appended claims.

The invention claimed is:

1. A field emission, linear and angular motion control micro-device coinprising a) a first cathodic electrode containing at least one, electron field emission whisker;

b) a second transparent grid electrode;

c) voltage means to provide potential Vg at said second electrode which establishes an electric field between the first and second electrodes;

d) said electric field produces a stream of field emitted electrons into the vacuum electric field space between said first and second electrodes;

e) a portion of said stream of field emitted electrons passing through said transparent grid electrode, thereby producing a positioning and motion control force on a moveable portion of said device, f) an ultimate collector electrode not physically attached to a moveable portion of said device g) said ultimate collector electrode at voltage $V \geqq V_g$ for collecting said stream of electrons; and h) the size of said micro-device ranging from nanometers to decimeters, i) where the device comprises a moveable portion and a stationary housing portion; the moveable portion comprising at least the first cathodic element and the second transparent grid electrode; the stationary housing portion comprising at least the ultimate collector electrode and at least partially enclosing the moveable portion.

2. The apparatus of claim 1, wherein said force acts on a hydraulic piston to produce force amplification.

3. The apparatus of claim 1, wherein said force acts on a cantilever to produce torque.

4. The apparatus of claim 1, wherein said force propels a wedge-shaped cathodic electrode of said device into a V-shaped receiving member to produce force amplification.

5. The apparatus of claim 1, wherein there is a second similar device in inverse spatial orientation to provide forward and backward motion.

6. The apparatus of claim 1, wherein there is a second similar device in perpendicular orientation to the first device to provide two axes positioning.

7. The apparatus of claim 1, wherein said force propels a protrusion of said device along an indented track to a given detent position.

8. The apparatus of claim 1, wherein a receptacle is placed upon said device for carrying and moving a specimen under a microscope.

9. The apparatus of claim 1, wherein said device is attached to an interferometer for dynamic motion over the range from constructive to destructive interference.

10. The apparatus of claim 1, wherein said device is fastened to a diffraction grating for dynamic motion of the grating elements.

11. The apparatus of claim 1, wherein said device is connected to the head of an atomic force microscope to control the spacing between the head and specimen.

12. The apparatus of claim 1, wherein said device is linked to an active optical element of an adaptive optics telescope to compensate for aberration due to atmospheric fluctuations.

13. The apparatus of claim 1, wherein said device is attached to the suspension arm which supports the head over an information storage disk to control the spacing of the head over the disk.

14. A negative ion linear and angular motion control, micro-device comprising a) a first cathodic electrode producing negative ions by electron attachment to impinging atoms;

b) a second transparent grid electrode;

c) voltage means to provide potential $V_g$ at said second electrode which establishes an electric field between the first and second electrodes;

d) said electric field producing a stream of negative ions into a low density electronegative gas in the electric field space between said first and second electrodes;

e) a portion of said stream of negative ions passing through said transparent grid electrode, thereby producing a positioning and motion control force on a moveable portion of said device, f) an ultimate collector electrode not physically attached to a moveable portion of said device g) said ultimate collector electrode at voltage $V \geqq V_g$ for detaching and collecting the electrons from said stream of negative ions; and h) the size of said micro-device ranging from nanometers to decimeters, i) where the device comprises a moveable portion and a stationary housing portion; the moveable portion comprising at least the first cathodic element and the second transparent grid electrode; the stationary housing portion comprising at least the ultimate collector electrode and at least partially enclosing the moveable portion.

15. The apparatus of claim 14, wherein said force acts on a hydraulic piston to produce force amplification.

16. The apparatus of claim 14, wherein said force acts on a cantilever to produce torque.

17. The apparatus of claim 14, wherein said force propels a wedge-shaped cathodic electrode of said device to produce force amplification upon a V-shaped receiving member.

18. The apparatus of claim 14, wherein there is a second similar device in inverse spatial orientation to provide forward and backward motion.

19. The apparatus of claim 14, wherein there is a second similar device in perpendicular orientation to the first device to provide two axes positioning.

20. The apparatus of claim 14, wherein said force propels a protrusion of said device along an indented track to a given detent position.

21. The apparatus of claim 14, wherein a receptacle is placed upon said device for carrying and moving a specimen under a microscope.

22. The apparatus of claim 14, wherein said device is attached to an interferorneter for dynamic motion over the range from constructive to destructive interference.

23. The apparatus of claim 14, wherein said device is fastened to a diffraction grating for dynamic motion of the grating elements.

24. The apparatus of claim 14, wherein said device is connected to the head of an atomic force microscope to control the spacing between the head and specimen.

25. The apparatus of daim 14, wherein said device is linked to an active optical element of an adaptive optics telescope to compensate for aberration due to atmospheric fluctuations.

26. The apparatus of claim 14, wherein said device is attached to the suspension ami which supports the head over an information storage disk to control the spacing of the head over the disk.

27. A positive ion, linear and angular motion control, micro-device comprising a) a first anodic electrode containing at least one whisker;

b) a second transparent grid electrode at voltage $V_g$, which establishes an electric field between the first and second electrodes;

c) said electric fleid produces a stream of positive ions into the vacuum electric field space between said first and second electrodes;

d) a portion of said stream of positive ions passing through said transparent grid electrode, thereby producing a positioning and motion control force on a moveable portion of said device, e) an ultimate collector electrode not physically attached to a movable portion of said device f) said ultimate cathodic collector electrode at voltage $|V| \geqq |V_g|$ for neutralizing said stream of positive ions by electron donation; and g) the size of said micro-device ranging from nanometers to decimeters, h) where the device comprises a moveable portion and a stationary housing portion; the moveable portion comprising at least the first cathodic element and the second transparent grid electrode; the stationary housing portion comprising at least the ultimate collector electrode and at least partially enclosing the moveable portion.

28. The apparatus of claim 27, wherein said force acts on a hydraulic piston to produce force amplification.

29. The apparatus of claim 27, wherein said force propels a wedge-shaped cathodic electrode of said device into a V-shaped receiving member to produce force amplification.

30. A method for producing a motive force in a micro-device comprising the steps of:

a) introducing a first cathodic electrode containing at least one, field emission whisker;

b) introducing a second transparent grid electrode;

c) applying a voltage $V_g$ at second electrode thereby establishing an electric field between the first and second electrodes;

d) said electric field producing a stream of negative particles into the electric field space between said first and second electrodes;

e) a portion of said stream of field emitted electrons passing through said transparent grid electrode, thereby producing a positioning and motion control force on a moveable portion of said device, f) an ultimate collector electrode not physically attached to a moveable portion of said device g) collecting said stream of negative particles at said ultimate collector electrode which is at voltage $V \geqq V_g$, h) the size of said micro-device ranging from nanometers to decimeters, i) where the device comprises a moveable portion and a stationary housing portion; the moveable portion comprising at least the first cathodic element and the second transparent grid electrode; the stationary housing portion comprising at least the ultimate collector electrode and at least partially enclosing the moveable portion.

31. The method of claim 30, wherein said force propels a wedge-shaped cathodic electrode of said device into a receiving member to produce force amplification.

32. The method of claim 30, wherein said force acts on a hydraulic piston to produce force amplification.

33. The method of claim 30, wherein said force acts on a cantilever to produce torque.

34. The method of claim 30, wherein said negative particles are electrons.

35. The method of claim 30, wherein said negative particles are negative ions.

36. The method of claim 30, wherein said device is fastened to a diffraction grating for dynamic motion of the grating elements.

37. The method of claim 30, wherein said device is connected to the head of an atomic force microscope to control the spacing between the head and specimen.

38. The method of claim 30, wherein said device is linked to an active optical element of an adaptive optics telescope to compensate for aberration due to atmospheric fluctuations.

39. The method of claim 30, wherein said device is attached to an interferometer for dynamic motion over the range from constructive to destructive interference.

40. A negative particle, linear and angular motion control micro-device comprising a) a first cathodic electrode containing at least one, electron field emission whisker;

b) a second transparent grid electrode;

c) voltage means to provide potential $V_g$ at said second electrode which establishes an electric field between the first and second electrodes;

d) said electric field produces a stream of negative particles into the electric field space between said first and second electrodes;

e) a portion of said stream of field emitted electrons passing through said transparent grid electrode, thereby producing a positioning and motion control force on a moveable portion of said device, f) an ultimate collector electrode not physically attached to a moveable portion of said device g) said ultimate collector electrode at voltage $V \geqq V_b$ for collecting said stream of negative particles; and h) the size of said micro-device ranging from nanometers to decimeters, i) where the device comprises a moveable portion and a stationary housing portion; the moveable portion comprising at least the first cathodic element and the second transparent grid electrode; the stationary housing portion comprising at least the ultimate collector electrode and at least partially enclosing the moveable portion.

41. The apparatus of claim 40, wherein said negative particles are electrons.

42. The apparatus of claim 40, wherein said negative particles are negative ions.

43. The apparatus of claim 40, wherein said force acts on a hydraulic piston to produce force amplification.

44. The apparatus of claim 40, wherein said force propels a wedge-shaped cathodic electrode of said device into a V-shaped receiving member to produce force amplification.

45. The apparatus of claim 40, wherein said device is attached to an interferometer for dynamic motion over the range from constructive to destructive interference.

46. The apparatus of claim 40, wherein said device is fastened to a diffraction grating for dynamic motion of the grating elements.

47. The apparatus of claim 40, wherein said device is connected to the head of an atomic force microscope to control the spacing between the head and specimen.

48. The apparatus of claim 40, wherein said device is linked to an active optical elejuerit of an adaptive optics telescope to compensate for aberration due to atmospheric fluctuations.

49. The apparatus of claim 40, wherein said device is attached to the suspension arm which supports the head over an information storage disk to control the spacing of the head over the disk.

50. The apparatus of claim 40, wherein a receptacle is placed upon said device for carrying and moving a specimen under a microscope.

* * * * *